US007540762B2

(12) United States Patent
Lin et al.

(10) Patent No.: US 7,540,762 B2
(45) Date of Patent: Jun. 2, 2009

(54) ELECTRICAL CONNECTOR

(75) Inventors: Min-Han Lin, Tu-cheng (TW); Kuo-Chun Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,213

(22) Filed: Jun. 25, 2008

(65) Prior Publication Data

US 2008/0318466 A1 Dec. 25, 2008

(30) Foreign Application Priority Data

Jun. 25, 2007 (TW) ..... 96210285 U

(51) Int. Cl.
*H01R 12/24* (2006.01)

(52) U.S. Cl. ..... 439/492; 439/495

(58) Field of Classification Search ..... 439/492–496
See application file for complete search history.

(56) References Cited

U.S. PATENT DOCUMENTS 5,044,980 A * 9/1991 Krumme et al. ..... 439/496
2007/0202737 A1 * 8/2007 Wei et al. ..... 439/495

FOREIGN PATENT DOCUMENTS

JP 2003-045518 2/2003

* cited by examiner

*Primary Examiner*—Khiem Nguyen
(74) *Attorney, Agent, or Firm*—Wei Te Chung

(57) ABSTRACT

An electrical connector (100) includes an insulating housing (10) defining a receiving space (12) for receiving a sheet-like connection member. A plurality of conductive terminals (20) each defines a contacting portion (241, 251) projecting to the receiving space. A slider (40) includes a tongue portion (43) to be movable inserted into the receiving space (12) and urging the sheet-like connection member to engage with the contacting portions. The tongue portion has a first portion (431) and a second portion (43) in an inserting direction thereof, and the second portion (43) is shorter than the first portion (431) in a longitudinal direction perpendicular to the inserting direction.

14 Claims, 7 Drawing Sheets

ELECTRICAL CONNECTOR

BACKGROUND OF THE INVENTION

1. Field of the Invention

The present invention relates to an electrical connector, and more particular to an electrical connector for a sheet-like connection member, such as an FPC.

2. Description of the Prior Art

Japanese Unexamined Patent Publication No. 2003-045518 discloses a conventional electrical connector adapted for connecting with a sheet-like connection member. The electrical connector includes an elongated insulating housing having a pair of opposed sidewalls and defining a receiving space therebetween. A plurality of conductive terminals is secured in the sidewalls with contacting portions projecting to the receiving space. A slider received in the receiving space has a plate like tongue portion and a pair of locking arms at opposite sides of the tongue portion. When a sheet-like connection member is inserted into the receiving space, the tongue portion of the slider is moved forwardly and the whole tongue portion is fully urging the sheet-like connection member to electrically contact with the contacting portions. As the contacting portions of the conductive terminals together with the sheet-like connection member are tightly engaging with the tongue portion of the slider, a large friction is produced between the tongue portion and the sheet-like connection member. Hence, a new design which can solve the problem is required.

SUMMARY OF THE INVENTION

Accordingly, an object of the present invention is to provide an electrical connector with a lower slider withdrawing force.

In order to achieve the object set forth, an electrical connector includes an insulating housing defining a receiving space for receiving a sheet-like connection member. A plurality of conductive terminals each defines a contacting portion projecting into the receiving space. A slider includes a tongue portion to be movable inserted into the receiving space and urging the sheet-like connection member to engage with the contacting portions. The tongue portion has a first portion and a second portion in an inserting direction thereof, and the second portion is shorter than the first portion in a longitudinal direction perpendicular to the inserting direction.

Other objects, advantages and novel features of the invention will become more apparent from the following detailed description of the present embodiment when taken in conjunction with the accompanying drawings.

DETAILED DESCRIPTION OF THE INVENTION

Figure 1:
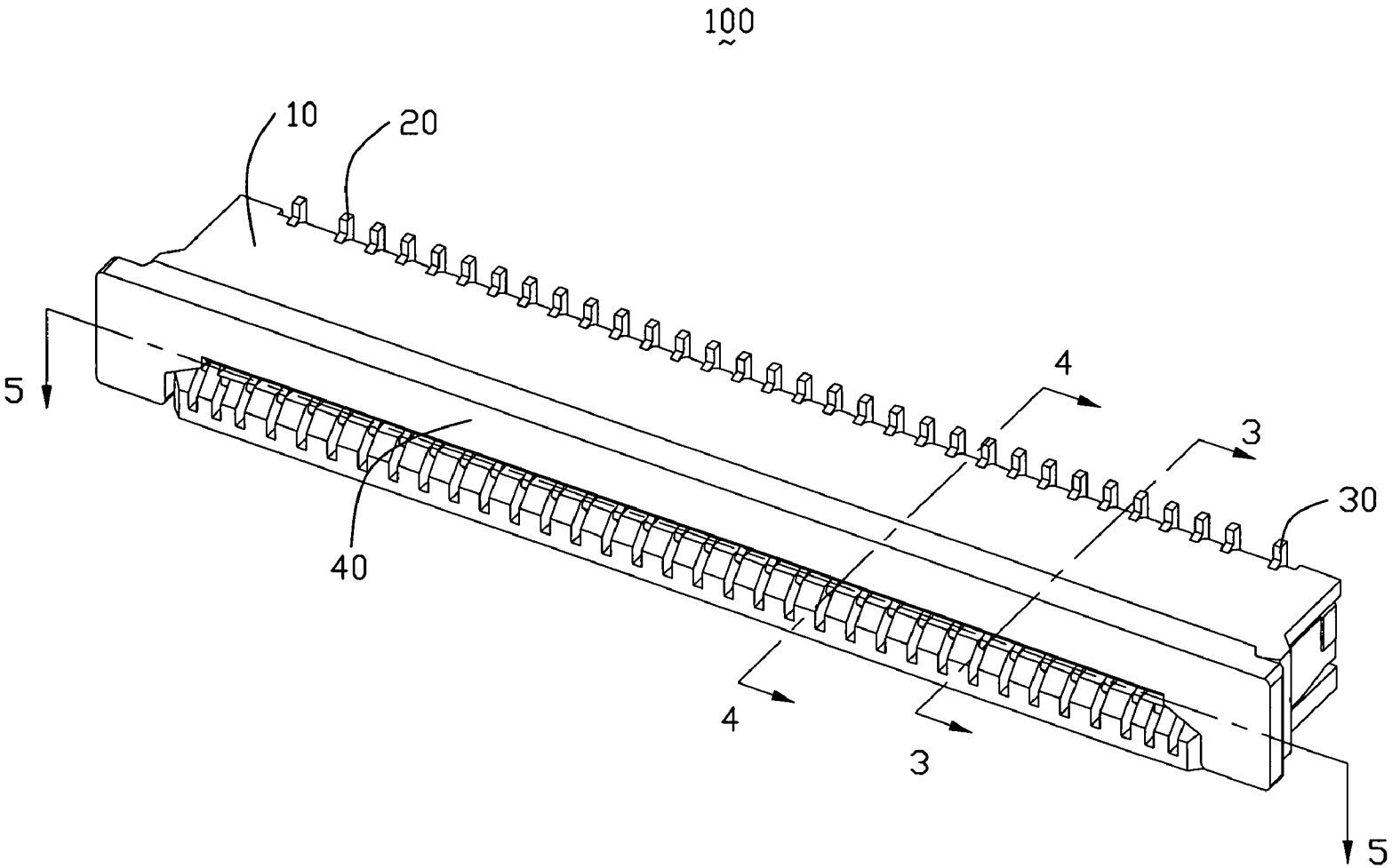
FIG. 1 is a perspective view of an electrical connector in accordance with the present invention.

Reference will now be made to the drawing figures to describe a preferred embodiment of the present invention in detail.

Figure 2:
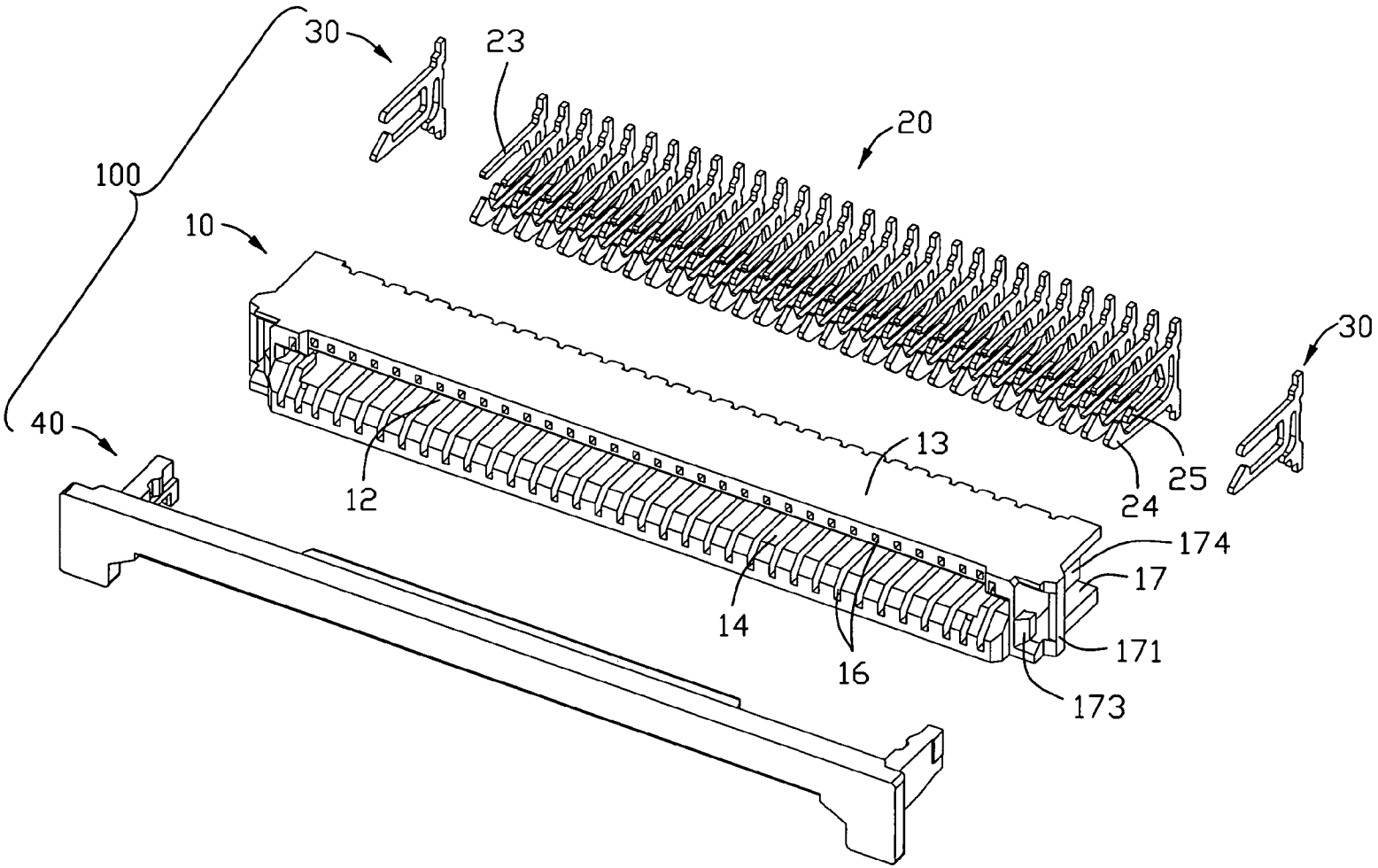
FIG. 2 is an exploded perspective view of the electrical connector shown in FIG. 1.

Referring to FIGS. 1 and 2, an electrical connector in accordance with the present invention is provided and comprises an elongated insulating housing 10, a plurality of conductive terminals 20, a pair of retaining members 30 and a slider 40.

The insulating housing 10 is provided with a receiving space 12 for receiving therein a sheet-like connection member, such as an FPC. The receiving space 12 is surrounded by a first wall 13, a second wall 14 and a pair of lateral walls connecting the first wall and second wall together. A plurality of terminal grooves 16 extending in an inserting direction of the FPC are arranged in the first wall 13 and second wall 14 along a longitudinal direction. The terminal grooves 16 in the second wall 14 run through an inner surface of the second wall and communicating with the receiving space 12. Both the first wall 13 and second wall 14 extend outwardly beyond the lateral walls in the longitudinal direction and therebetween forming a guiding groove 174 communicating a lateral exterior. A rib 171 integrally links with the front edge of the guiding groove 174, thereby defining a guiding opening. Two protrusions 172, 173 (as shown in FIG. 3) are respectively formed at a front portion and a middle portion of the guiding groove 174.

Figure 3:
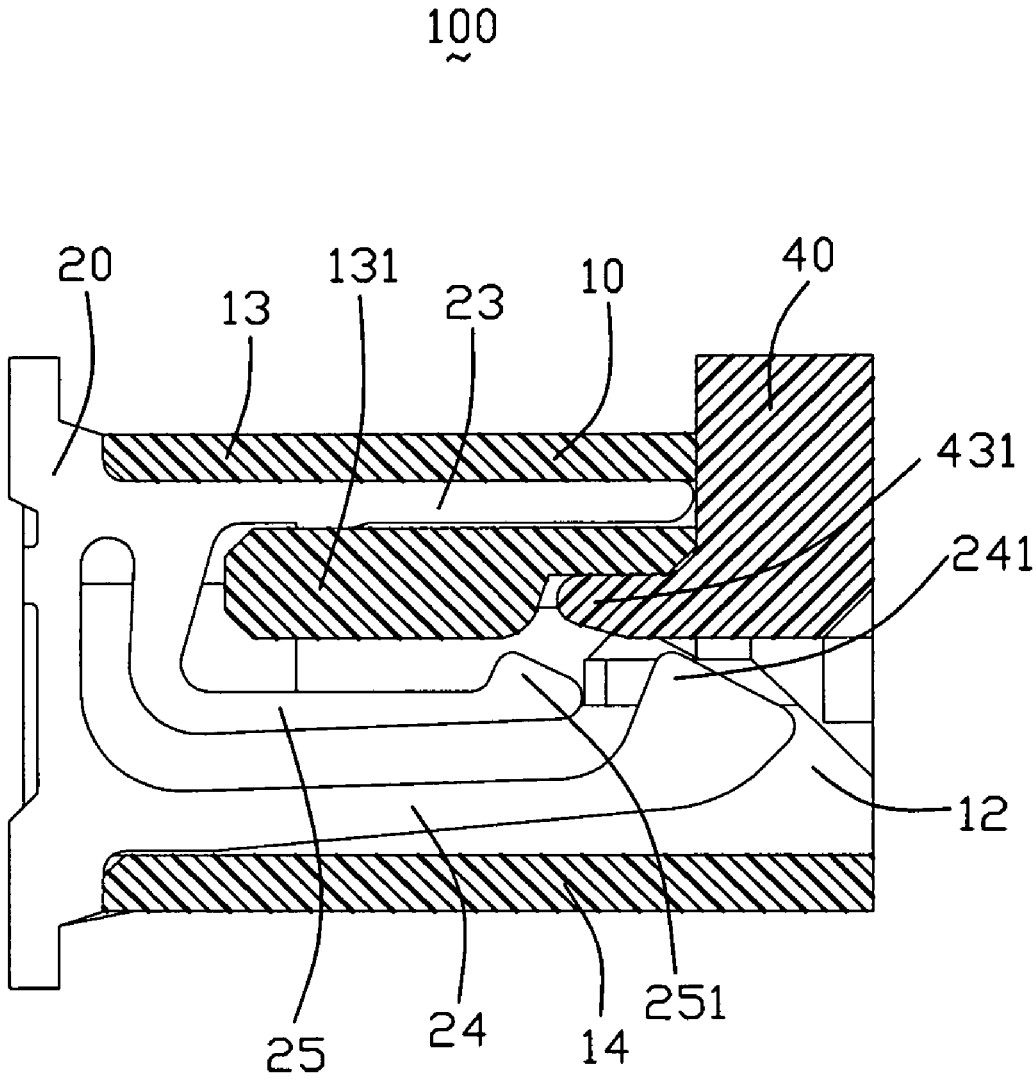
FIG. 3 is a cross sectional view of the electrical connector shown in FIG. 1 along line 3-3.
Figure 4:
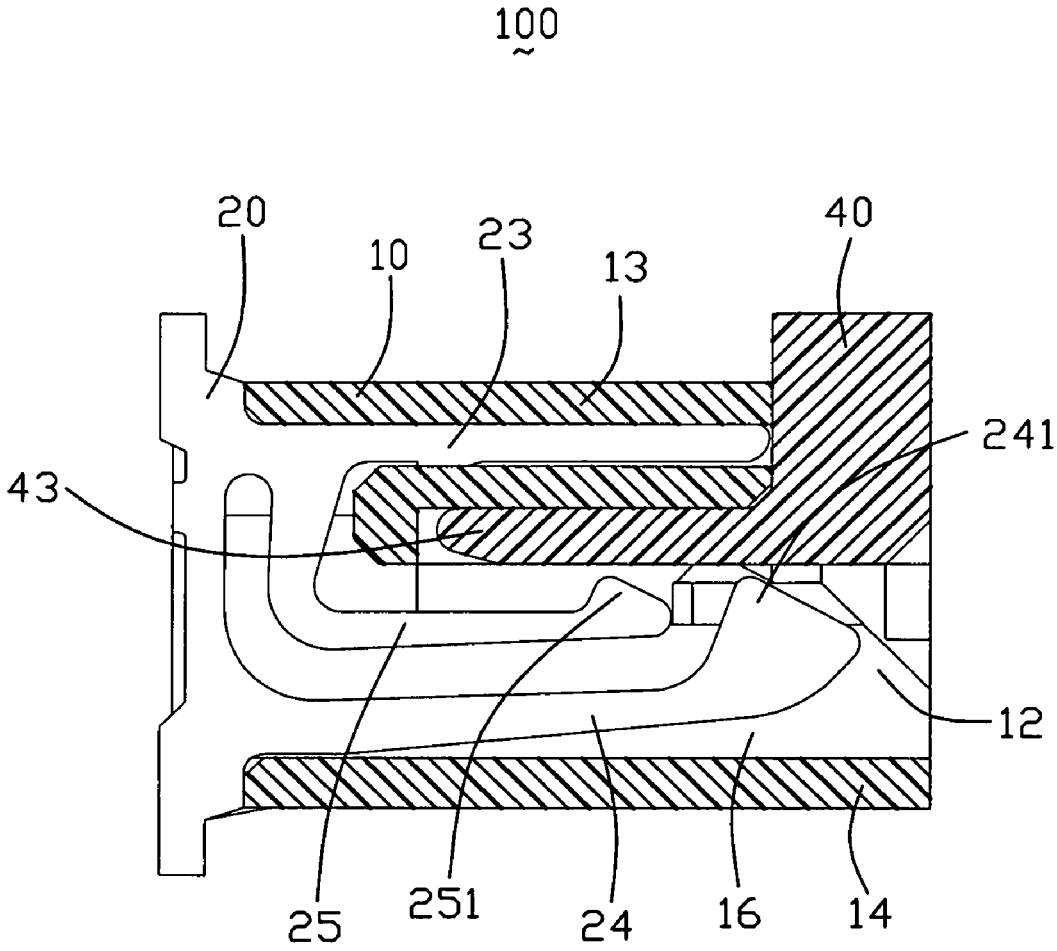
FIG. 4 is a cross sectional view of the electrical connector shown in FIG. 1 along line 4-4.

Referring to FIGS. 3 and 4, the conductive terminals 20 are respectively received in the terminal grooves 174 and each conductive terminal 20 comprises a base portion 26 and a retaining arm 23 perpendicular extending from one end of the base portion 26. A first contacting arm 24 parallel to the retaining arms 23 extends from the other end of the base portion 26 with a first contacting portion 241 projecting upwardly at a distal end thereof. A second contacting arm 25 branches downwardly from a root portion of the retaining arm 23 and then extends forwardly parallel to the first contacting arm 24. The second contacting arm 25 is shorter than the first contacting arm 24 in the inserting direction, therefore a second contacting portion 251 formed at a distal end of the second contacting arm 25 is disposed at an inner side of the first contacting portion 241. The first contacting portion 241 and the second contacting portion 251 are formed at a same plane so as to contact with a same conductive pad on the FPC.

The retaining member 30 is in a similar shape to the conductive terminals 20 but without a first contacting arm. The pair of retaining members 30 are respectively inserted into the terminal grooves 16 at ends of the receiving space 12 to lock with the FPC.

Figure 6:
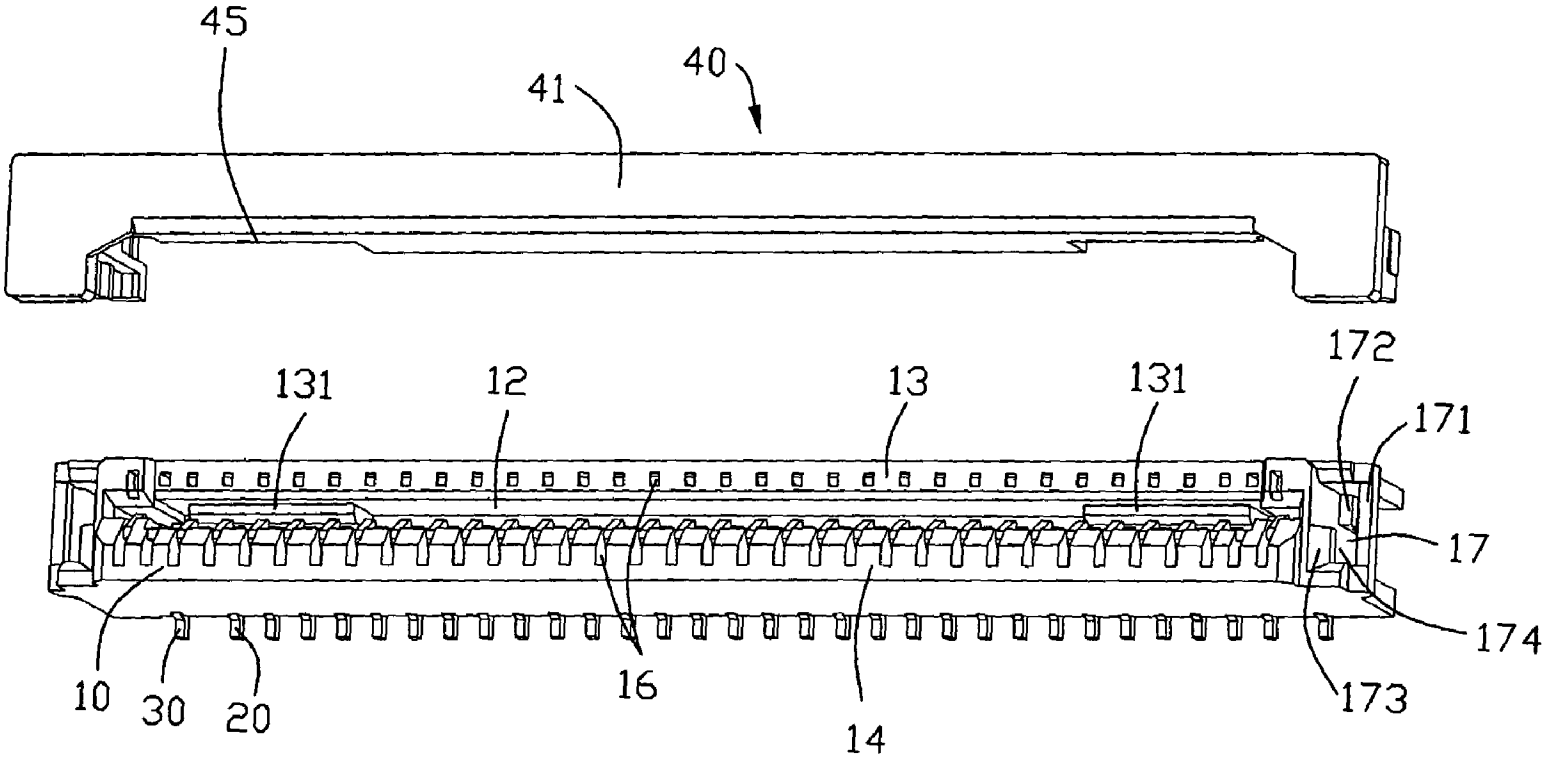
FIG. 6 is another exploded perspective view of the electrical connector.
Figure 7:
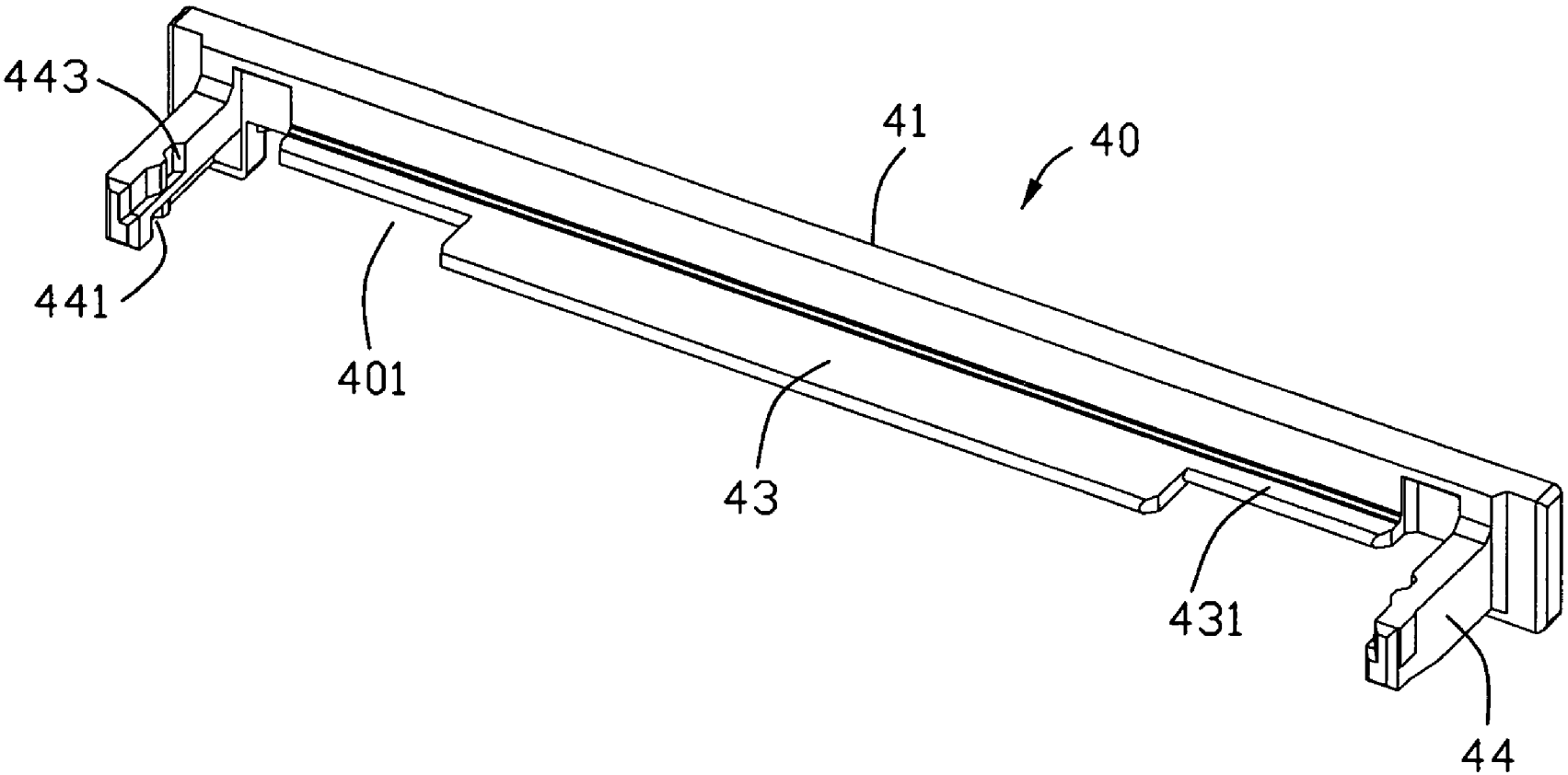
FIG. 7 is a perspective view of a slider of the electrical connector.

Referring to FIGS. 6 and 7, the slider 40 has a rectangular base portion 41 with an opening 45 (as shown in FIG. 6) at one side thereof, a tongue portion 43 vertically extending from the base portion and a pair of latching arms 44 extending from longitudinal ends of the base portion. The latching arms 44 are spaced with the tongue portion 43 and slide in the corresponding guiding grooves 174. Each latching arm 44 is excavated partly at its side along an extending direction thereof and forms a hook shaped grasping portion 441 at a distal end. The other side of the latching arm is also excavated partly and forms a retaining portion 443 at a middle portion.

The tongue portion is in a step shape and comprises a first tongue plate 431 directly extending from one side of the base portion 41 and a second tongue plate 43 protruding forwardly from a front edge of the first tongue plate 431. The second tongue plate 43 is shorter than the first tongue plate 431 in the longitudinal direction, therefore a pair of openings 401 are formed at opposite ends of the second tongue plate 43. Bottom surfaces of the first and second tongue plate 431, 43 are in a same plane so as to press the FPC to electrically connect with the conductive terminals 20. Moreover, the front edge of the second tongue plate 43 forms a slanting surface thereon, therefore the slider 40 is easily inserted into the receiving space 12.

Figure 5:
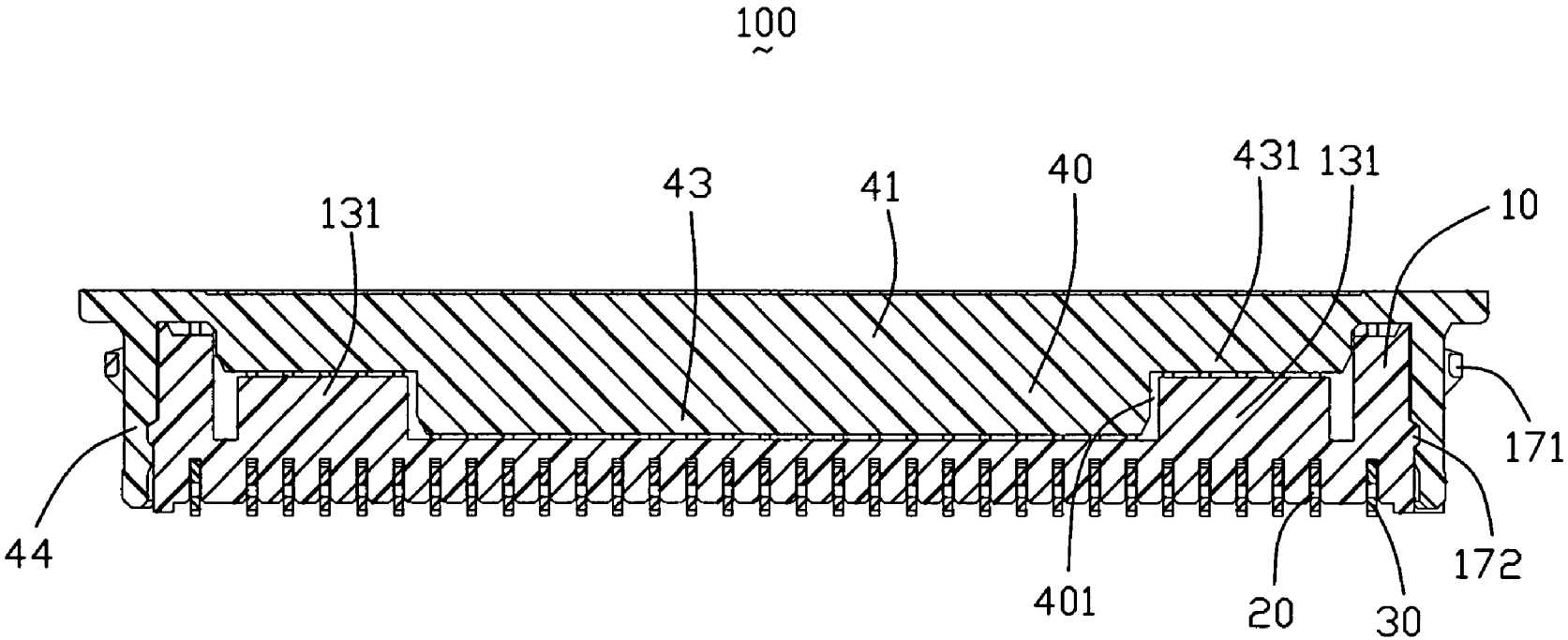
FIG. 5 is a cross sectional view of the electrical connector shown in FIG. 1 along line 5-5.

Referring to FIGS. 5 and 6, a pair of emboss portions 131 are respectively formed on both ends of an inner surface of the first wall 13 and facing the conductive terminals 30. When the FPC is inserted into the receiving space 12, two ends of the FPC are clamped by the emboss portions 131 and the first and second contacting portions 241, 251 of the conductive terminals 20. Then the tongue plate of the slider 4 is moved forwardly, and the first and second tongue plates 431, 43 press part of the FPC to electrically connect with the conductive terminals 20. Meanwhile, the emboss portions 131 are just positioned in the openings 401. The latching arms 44 are received in the guiding grooves 174 with the protrusion 172 locking with the retaining portion 443.

In this embodiment, the tongue plate of the slider 40 defines a pair of openings 401 at opposite ends, therefore the contacting area between the tongue plate and FPC is reduced and the friction therebetween can be reduced, which is advantage for the slider 40 to be inserted into and pulled out of the receiving space 12. More, the emboss portions 131 together with the contacting portions of the terminals 20 can fix opposite ends of the FPC.

In other embodiment, middle portion of the tongue plate 42 can be excavated and defines an opening, which can also realize the desired function. The electrical connector can realize lower withdrawing force of the slider 40, which can available protect the slider 40 from being destroyed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a receiving space for receiving a sheet-like connection member;

a plurality of conductive terminals each defining at least one contacting portion projecting into the receiving space; and a slider comprising a tongue portion to be movable inserted into the receiving space and urging the sheet-like connection member to engage with the contacting portions;

wherein the tongue portion has a first portion and a second portion in an inserting direction thereof, and the second portion is shorter than the first portion in a longitudinal direction perpendicular to the inserting direction.

2. The electrical connector as described in claim 1, wherein a pair of emboss portions are respectively formed on an inner portion of the insulating housing and facing the receiving space, the second portion is received between said emboss portions when the slider is inserted into the receiving space.

3. The electrical connector as described in claim 1, wherein the second portion protrudes from a front edge of the first portion and defines a pair of openings at longitudinal ends.

4. The electrical connector as described in claim 1, wherein the second portion defines a slanting surface at a front edge.

5. The electrical connector as described in claim 1, wherein bottom surfaces of the first and second portion are in a same plane so as to press the sheet-like connection member to electrically contact with the contacting portions.

6. The electrical connector as described in claim 1, wherein each conductive terminal comprises a first and a second contacting arms, the at least one contacting portion comprises a first and a second contacting portions formed at distal end of the first and second contacting arms, and the first and second contacting portions are in a same plane.

7. An electrical connector for connecting a sheet-like connection member comprising:

an insulating housing comprising a first wall, a second wall and a pair of side walls defining a receiving cavity therebetween;

a plurality of conductive terminals having contacting portions; and a slider comprising a base portion and a tongue portion perpendicular extending from the base portion and being insertable into the receiving cavity;

wherein the tongue portion defines at least one opening thereof so as to decrease contacting surfaces with the sheet-like connection member while the sheet-like connection member is inserted into the receiving cavity.

8. The electrical connector as described in claim 7, wherein the at least one opening comprises a pair of openings defined at opposite ends of a front edge of the tongue portion.

9. The electrical connector as described in claim 8, wherein a pair of emboss portions are formed on an inner surface of the first wall, and the emboss portions are received in said openings when the slider is inserted into the receiving cavity.

10. The electrical connector as described in claim 7, wherein the at least one opening comprises an opening defined in a middle portion of a front edge of the tongue portion.

11. An electrical connector comprising:

an insulative elongated housing defining an elongated slot along a lengthwise direction thereof;

a plurality of contacts disposed in the housing, each of said contacts defining front and rear contacting sections extending into the slot; and a slider including a base portion and a tongue portion extending from the base portion and into the slot; wherein the tongue portion includes front and rear contacting regions, in an insertion direction of the slider, respectively confronting the corresponding rear contacting sections and front contacting sections in a vertical direction, under a condition that the rear contacting region is larger than the front contacting region.

12. The electrical connector as claimed in claim 11, wherein said tongue defines a cutout in said front contacting region.

13. The electrical connector as claimed in claim 12, wherein the housing defines a protrusion received in said cutout.

14. The electrical connector as claimed in claim 13, wherein the protrusion confronts the corresponding rear contacting sections in said vertical direction instead of the front contacting region.

* * * * *